US006467531B1

(12) United States Patent
Doney

(10) Patent No.: US 6,467,531 B1
(45) Date of Patent: Oct. 22, 2002

(54) METHOD AND APPARATUS FOR PRODUCING INVESTMENT CASTINGS IN A VACUUM

(76) Inventor: Clyde D. Doney, 2780 County Rd., 207, Durango, CO (US) 81303

( * ) Notice: Subject to any disclaimer, the term of this patent is extended or adjusted under 35 U.S.C. 154(b) by 0 days.

(21) Appl. No.: 09/687,974

(22) Filed: Oct. 14, 2000

Related U.S. Application Data

(60) Provisional application No. 60/159,966, filed on Oct. 18, 1999.

(51) Int. Cl.[7] ..... B22D 18/06; B22C 9/00

(52) U.S. Cl. ..... 164/255; 164/256; 164/63; 164/23; 164/339

(58) Field of Search ..... 164/255, 61–65, 164/253, 254, 256, 257

(56) References Cited

U.S. PATENT DOCUMENTS 3,774,668 A * 11/1973 Iten et al. ..... 164/255
4,791,977 A * 12/1988 Chandley ..... 164/63

* cited by examiner

*Primary Examiner*—M. Alexandra Elve
*Assistant Examiner*—Kevin L. McHenry

(57) ABSTRACT

A gravity pour vacuum casting method and apparatus providing uniform set-up provisions for gas permeable molds regardless of mold size, shape, or mold type employed in accordance with the present invention. Apparatus includes a sprue-forming device that when combined with a disposable foundry patter and subsequently invested together as a unit forms a gas permeable mold in accordance with the present invention, and further includes a vacuum chamber configured to match corresponding counterparts of said sprue-forming device.

2 Claims, 6 Drawing Sheets

METHOD AND APPARATUS FOR PRODUCING INVESTMENT CASTINGS IN A VACUUM

CROSS-REFERENCES TO RELATED APPLICATIONS

This application is entitled to the benefit of Provisional Patent Application Ser. No. 60/159,966, filed Oct. 18, 1999.

STATEMENT REGARDING FEDERALLY SPONSERED RESEARCH OR DEVELOPMENT

Not Applicable

REFERENCE TO A MICROFICHE APPENDIX

Not Applicable

BACKGROUND OF THE INVENTION

1. Field of the Invention

The present invention relates generally to the art of investment casting and more specifically to a method and apparatus for combining a conforming gas permeable mold within a correspondingly suitable vacuum chamber in a manner that subjects said mold to vacuum pressure while molten metal is introduced by gravity means from outside the vacuum chamber.

2. Description of the Related Art

The basic principles and methodogoly of investment or "lost wax" casting have remained basically the same during the 6000 years it has been practiced. Investing a disposable pattern in a mold, eliminating the disposable pattern by burning it out, and introducing molten metal into the resultant mold cavity has never changed other than the quality of materials and equipment technology employed in the process. However, there have been many improvements made in the art during the time it has been known. Among the most important developments in modern times include the discovery that vacuum pressures applied to a gas permeable mold while molten metal is added will greatly enhance the fill out probabilities of complex shapes which otherwise depend entirely on sprue weight, elaborate conduits, venting gates, and hydrostatic pressures to completely fill out a complex mold.

Major changes in recent years have advanced vacuum assisted casting to the point where it is now standard practice to produce very complex articles, including highly detailed finished parts that require no additional machining, expensive assembly procedures, or further finishing of the cast article beyond sprue removal. Prior art examples include a wide variety of vacuum casting methods and equipment, which have proven to be successful in their intended applications. However, of the various processes heretofore used or proposed for use, few have received commercial consideration for high production industrial applications involving the precision casting of large and complex articles. The inherent fragility of large gas permeable molds such as ceramic shell molds hinder the progress towards utilizing vacuum casting for a broader range of casting applications. The method and apparatus comprising the present invention provide the combined benefits and advantages of ceramic shell molds with an ability to more economically produce larger, and more detailed precision castings requiring only minimum rework for manufacturing a finished product.

Therefore it is the primary objective of the present invention to reinforce and strengthen ceramic shell molds in a manner that makes them self-supporting, and to provide a uniform means for said molds to be mounted and sealed within a vacuum chamber regardless of mold size, shape, or mold type used, up to the size limitations of the particular vacuum chamber used in the process. The invention further permits molten metal to be introduced by gravity means from outside the vacuum chamber while said mold remains subjected to vacuum pressure.

It is another object of the invention to provide a method and apparatus that more efficiently drains melted pattern material from the mold during the pattern elimination process resulting in a cleaner mold at the beginning of the burnout phase, consequently reducing exposure to smoke and pollution in the workplace and to reduce undesirable emissions into the atmosphere.

It is still another object of the invention to provide a method and apparatus that furnishes a means for handling sprued patterns and finished molds safely to lessen the chance of damage while investing, drying, and setting up the mold for casting. Other related objectives and advantages are:

(a) To provide an improved method and apparatus that increases yield of the metal being cast by reducing the amount of metal that must be cut off the cast article in the form of sprues, gates, and risers.

(b) To provide an improved method and apparatus that allows thinner walled castings to be cast resulting in lighter finished articles and consequently less costly articles.

(c) To provide an improved method and apparatus that is applicable to the casting of a wide variety of different metals, including both ferrous and nonferrous metals.

(d) To provide an improved method and apparatus that permits the casting of articles of varying sizes and shapes one after the other in any desired order on a single production line thereby speeding up production and reducing costs.

(e) To provide an improved method and apparatus that can be used to sprue and cast any number of articles of any given configuration within a single mold up to the size limitations of the vacuum casting unit being used.

(f) To provide an improved method and apparatus that is capable of use with a variety of different casting designs involving different types of casting molds such as poured investment molds, ceramic shell molds, multiple mold sections, inserts, disintegrable cores, and the like.

(g) To provide an improved method and apparatus that can be used to cast different mold types one after the other in any desired order.

(h) To provide an improved method and apparatus that requires fewer production man-hours to be expended due to the high quality and precise detail of the cast articles.

(i) To provide an improved method and apparatus that is adaptable to high production output by combining any desired number of vacuum casting chambers in successive order such as a carousel arrangement or the like.

(j) To provide an improved method and apparatus that is reasonably simple and safe enough for use in a home workshop or teaching facility as well as a commercial foundry and is versatile enough for smaller units to be transported and used at any convenient site such as demonstration workshops or the like.

(k) To provide an improved apparatus that has a long operating life and minimal maintenance requirements.

(l) To provide an improved apparatus that accommodates any size, type, or shape of gas permeable mold in random or any desired order up to the maximum size of the vacuum casting unit used.

(m) To provide a method and apparatus suitable for space manufacturing projects utilizing the natural vacuum outside the earth's atmosphere. Further objectives and advantages of my invention will become apparent from a consideration of the drawings and ensuing description.

BRIEF SUMMARY OF THE INVENTION

The invention discloses a vacuum casting unit and a gas permeable mold, both being equipped with uniform mounting, sealing, and filling features configured to register with their corresponding counterparts. When a ready to cast gas permeable mold is set-up in an activated vacuum casting unit, molten metal is introduced into said mold by gravity means from outside the vacuum chamber while the mold is subjected to vacuum pressure.

The vacuum casting unit consists of a vacuum tank with a means for connecting and controlling a vacuum device, and a top closure that when joined together form a vacuum chamber configured to accept a correspondingly configured gas permeable mold.

Features of the top closure include a flat sealing surface with an orifice, through which a sprue-forming device, in accordance with this invention, projects and extends a gas permeable mold's sprue, and through which molten metal is introduced into the vacuumized gas permeable mold's cavity by gravity means. The top closure further includes adjustable hanger devices that connect the gas permeable mold to the top closure and which provides the means to adjust the gas permeable mold's sealing properties from outside the vacuum chamber by lowering or raising the mold up to form a tighter abutment between the sealing surfaces.

The invention discloses a sprue-forming device that when combined with a disposable foundry pattern and subsequently invested together as a unit forms a gas permeable mold in accordance with this invention. Said sprue-forming device furnishes uniform sprue, mounting, and sealing features for all sizes, shapes, and mold types pertinent to this invention. The preferred embodiment of said sprue-forming device forms a structural framework that surrounds the disposable foundry pattern and carries all the weight of the mold through every step of the foundry process. Said sprue-forming device is comprised of a sprue former ring, a base plate, and other structural elements such as tie wire and connecting rods or other suitable equivalents depending upon the amount of support required for a particular application. A sprue former ring is required to be sprued and invested as an integral part of all molds utilized in this process. The sprue-forming device may be structured to the most appropriate form conditional to the disposable foundry pattern and mold type being cast.

The sprue former ring is comprised of a sprue former flask a sealing surface, and mounting device all axially arranged and permanently fixed together. Said sprue former flask is a hollow metal cylinder, flanged at one end to form the sprue former ring's sealing surface. Set-up of a sprue former ring to a disposable foundry pattern involves attaching a wax, or it's equivalent, sprue pattern to the disposable foundry pattern. Said wax sprue pattern is long enough to extend concentrically all the way through the sprue former flask where it is invested in place. After burning out the mold, a sprue is left through the investment that now lines the sprue former flask and through which, molten metal gravity flows into the mold cavity during casting. The exterior surface of the sprue former flask and its associated sealing surface must be kept clean and free of investment before setting the mold up in the vacuum chamber in order for the sprue former flask to slip freely through the top closure's center hole and to allow tight contact between sealing surfaces.

The aforementioned base plate, when used as part of a sprue-forming device, is positioned at the opposite end from the sprue former ring and held in place by connecting rods secured by winding tie wire around each juncture of a connecting rod with a base plate anchor bar and sprue former ring. The base plate includes a handle mount and a concentrically located drain port. A handle may be threaded into said handle mount to provide for convenient handling of unwieldy molds. The drain port serves two functions. First, it provides alignment for a wax coated sprue pipe when the disposable foundry pattern is sprued, and secondly, during the pattern elimination phase it provides a conduit for melting pattern material to flow out of the mold cavity. Alignment of the sprue pipe with the base plate is assured by threading an alignment plug through the drain port. The alignment plug is a long bolt that is threaded for part of its length and smoothed to a smaller diameter for the remainder of its length. The outside diameter of the smooth part of the alignment plug allows that portion of the alignment plug to slip fit into the inside of the wax coated sprue pipe holding it firmly in place until investing is complete. After investing is complete, and when the investment is thoroughly dry, the alignment plug is removed to facilitate pattern elimination. After burnout and before setting the gas permeable mold up in the vacuum chamber a drain plug must be threaded into the drain port to seal the mold cavity.

While the invention is described in connection with certain described embodiments and applications, it will be understood that it is not intended to limit the invention to these particular descriptions or uses. On the contrary, it is intended to cover all alternatives, modifications, and equivalent arrangements as may be included within the scope of this invention.

DETAILED DESCRIPTION OF THE INVENTION

Figure 1:
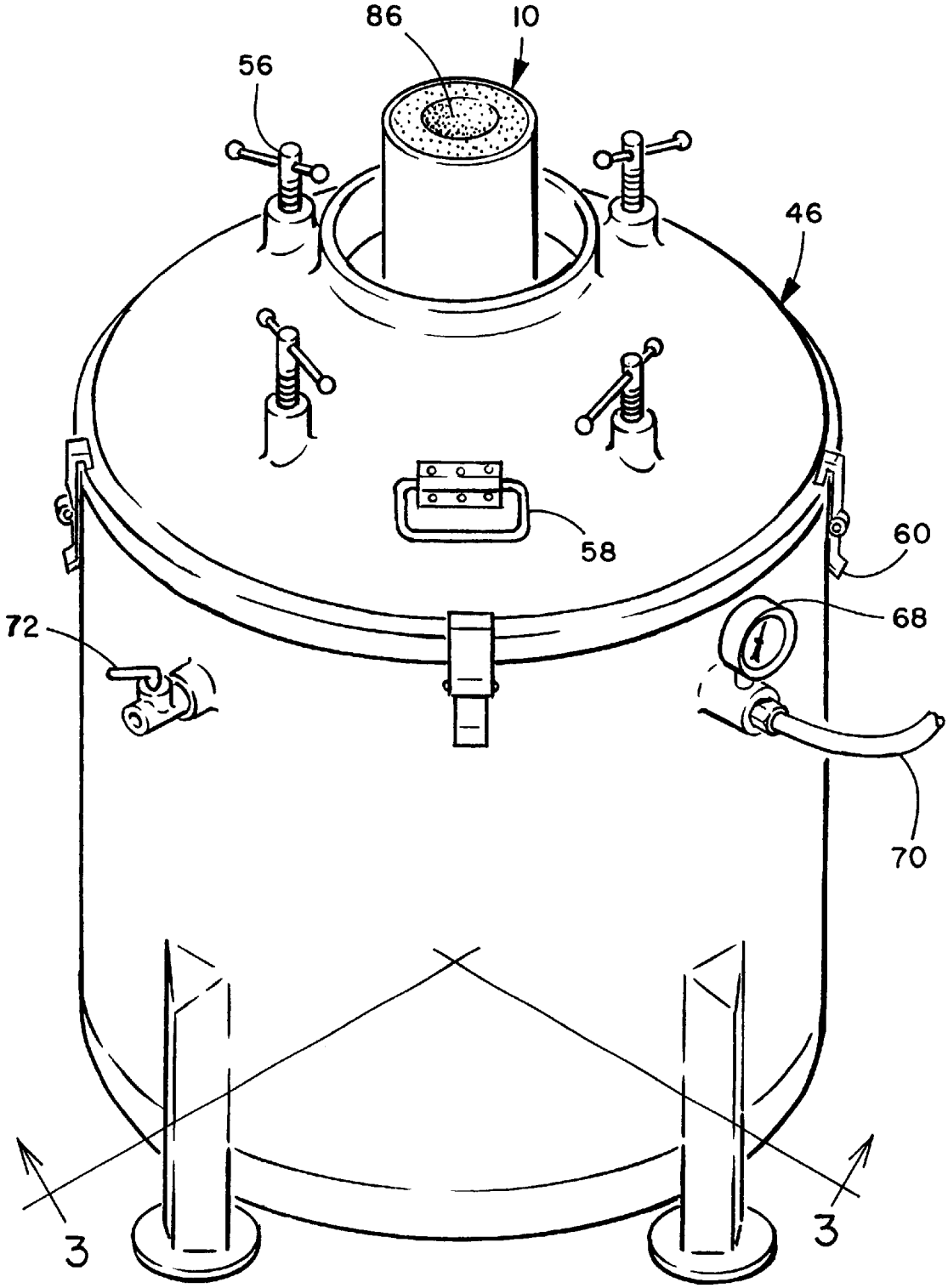
FIG. 1—Is an isometric view of a typical vacuum casting apparatus containing a ready to cast gas permeable mold in accordance with the present invention.
Figure 3:
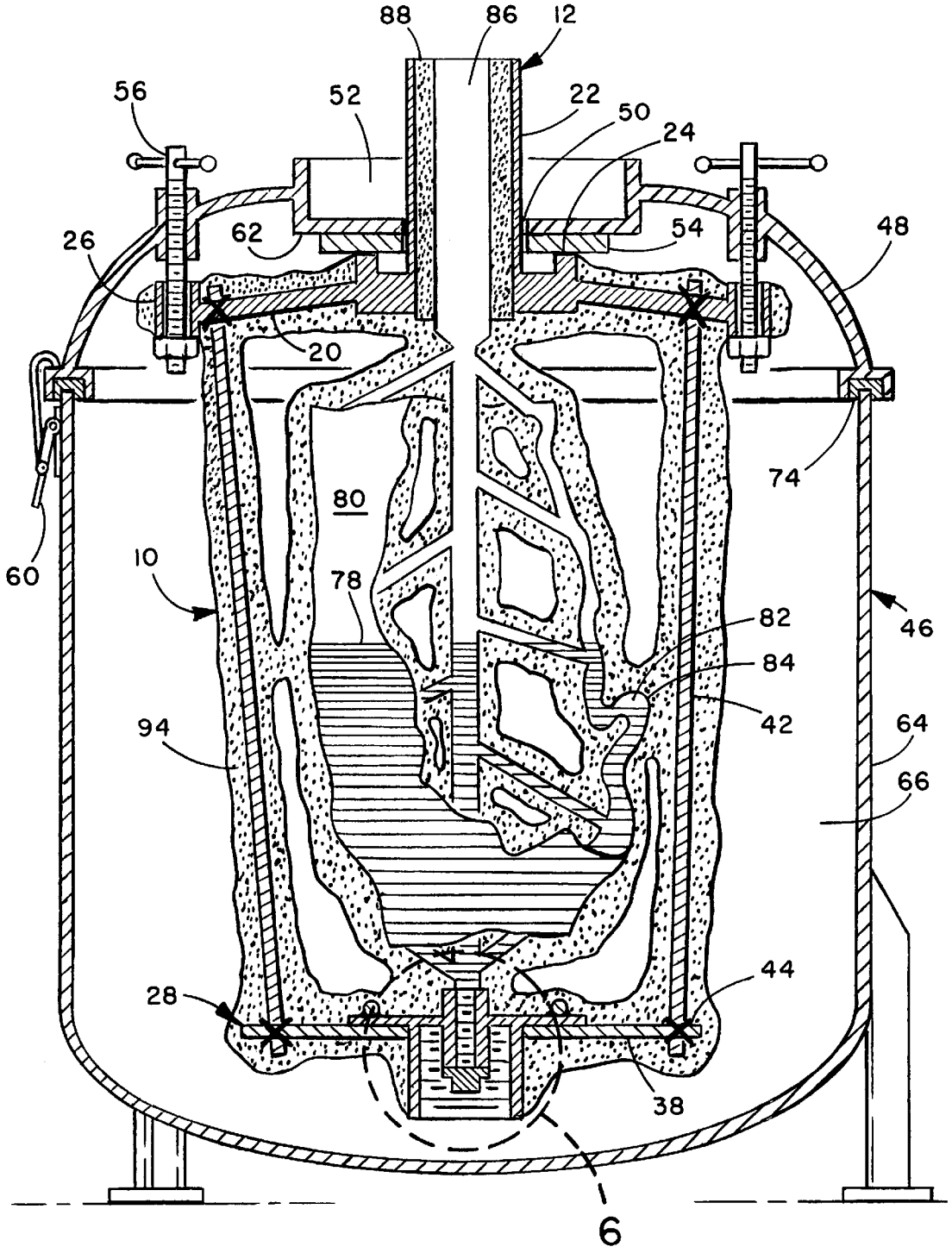
FIG. 3—Shows a simplified cross sectional view through a vacuum casting apparatus containing a large gas permeable mold being cast in accordance with the present invention.

A preferred embodiment of the present invention is illustrated in FIG. 1 (isometric view) and FIG. 3 (cross sectional view) showing a loaded and sealed vacuum casting unit 46 which when vacuumized is ready to accept molten metal into gas permeable mold 10 through mold sprue 86. Vacuumization is accomplished by activating a vacuum device (not shown) connected to vacuum pump connecting port 70.

A ready to cast gas permeable mold 10, in accordance with the present invention, is conjoined with a top closure 48 (FIG. 3) by inserting sprue former flask 22 through center hole 50 and seating sealing surface 24 against sealing surface 62 by physical abutment and latching the two parts together by attaching mounting devices 26 to adjustable hanger devices 56. Sealing surface 24 must fit flat and tight against sealing surface 62 to ensure proper vacuum pressure. A compressible seal 54 may be placed between the two sealing surfaces should either sealing surface become warped or damaged from repeated use or rough handling.

Top closure 48 along with it's conjoined gas permeable mold 10 is installed as a unit into vacuum tank 64 and secured with latching devices 60 which squeezes compressible seal 74 thereby resulting in a tight seal between top closure and vacuum tank. Air is evacuated from the vacuum chamber 66 when vacuum device (not shown) is activated. Further sealing, if needed, is accomplished by turning adjustable hanger devices 56 upward to raise the ready to cast gas permeable mold 10 and it's sealing surface 24 up tighter against sealing surface 62 inside the vacuum chamber 66. Set up is complete and ready to cast when vacuum gauge 68 indicates negative pressures exist in vacuum chamber 66. Complete vacuum is not achievable at this point in the operation due to the vacuum drawing outside air into the mold cavity 80 through the exposed mold sprue 86 and thus through the gas permeable mold wall 84, which stabilizes low pressure in the vacuum chamber. Once no more air leaks are detected, molten metal can then be gravity poured into mold sprue 86. As molten metal 78 rises in mold cavity 80 (FIG. 3), any trapped air 82 is evacuated from mold cavity 80 through mold wall 84 of gas permeable mold 10. At the same time, vacuum pressure holds the molten metal tight against the inside wall of the mold cavity where it is held in place until solidification of the metal is complete. Vacuum pressure is maintained for a brief time after pouring to allow the molten metal to completely solidify in place thereby lessening potential shrinkage problems in the cast article (not shown). Accidental spillage of molten metal may occur while pouring due to misalignment of the crucible (not Shown) or because of over filling the sprue till run over occurs. Such waste metal flows into spill guard 52 where it is contained, thereby preventing molten metal from flowing into the work area and endangering those in the workplace.

The cast mold is removed from vacuum chamber 66 by opening vacuum release valve 72 and relieving vacuum pressure, then releasing latching devices 60 in order to lift top closure 48 along with the cast mold clear of vacuum tank 64 using lifting devices 58 if needed. The cast mold is then separated from top closure by disengaging adjustable hanger devices 56 from mounting devices 26. Compressible seal 54, when used, is removed from sprue-forming device 12 and saved for future use.

The cast article (not shown) is retrieved from its mold by breaking away the ceramic shell investment 94 coating the cast article and the sprue-forming device. The investment is broken up and chipped off the sprue-forming device whereby all metal parts are sandblasted clean and reused. The cast article is further processed according to conventional foundry practices.

Figure 2:
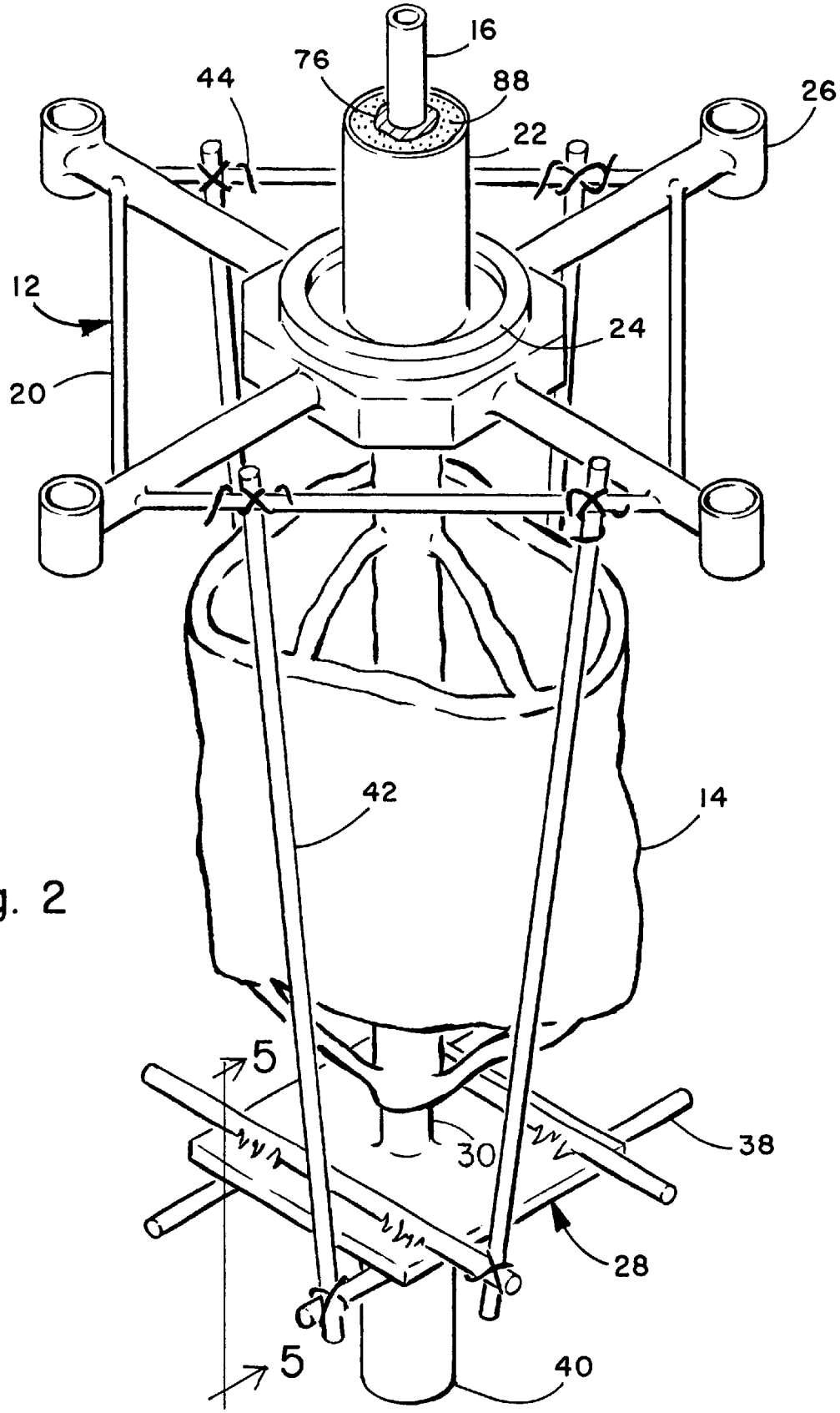
FIG. 2—Shows a typical embodiment, isometric view, of a large disposable foundry pattern sprued to a sprue-forming device and ready to invest in accordance with the present invention.

FIG. 2 illustrates a preferred method of sprueing a large disposable foundry pattern 14 requiring maximum structural strength and support. Metal components comprising sprue-forming device 12 form a cage that surrounds a disposable foundry pattern. Said cage supports and carries all the weight of the gas permeable mold before and after casting. Molds requiring maximum structural strength are supported by conjoining base plate 28 to sprue former ring 20 with connecting rods 42. Said base plate forms a platform when suspended from sprue former ring 20 by connecting said base plate to said sprue former ring with connecting rods 42 and firmly securing all joints with tie wire 44 or suitable equivalent. Said base plate is comprised of a drain port 30, a handle mount 32 (FIGS. 5, and 6,), and base plate anchor bars 38. Said base plate anchor bars along with sprue former ring 20 provide solid attachment points for connecting rods 42.

Molds deemed strong enough to require minimal support need only have tie wire 92 (FIG. 4), or suitable equivalent, looped loosely around (but not touching) the disposable foundry pattern 98 and secured to sprue former ring 20. Said tie wire, when invested as an integral part of a gas permeable mold, performs the same function for a gas permeable mold as the aforementioned cage. Investing is done according to conventional foundry methods.

Figure 4:
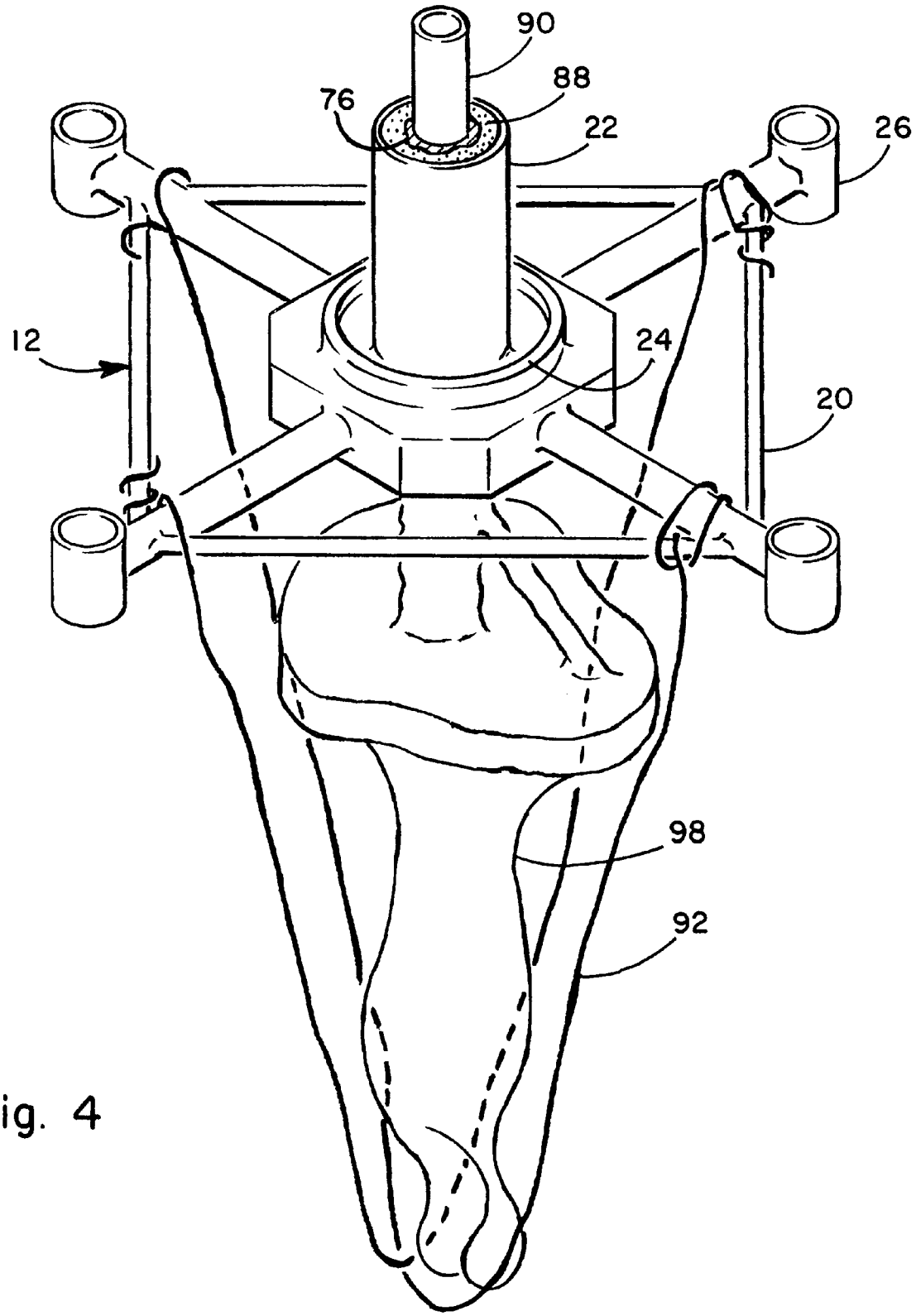
FIG. 4—Is an isometric view of an alternative embodiment of sprued and ready to invest small disposable foundry pattern in accordance with the present invention.
Figure 7:
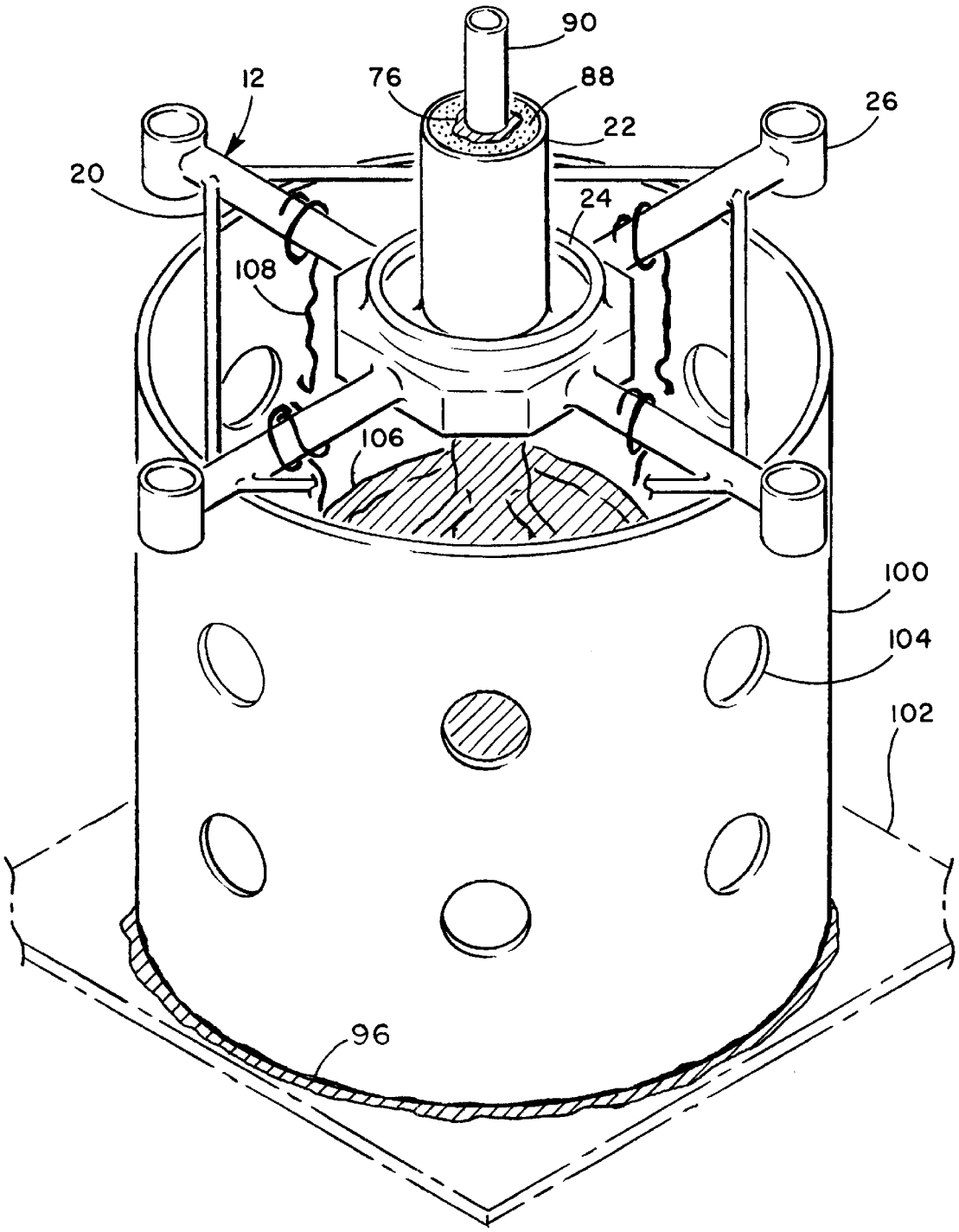
FIG. 7—Is an isometric view showing a typical flask mold ready for investing in accordance with the present invention.

Disposable foundry pattern configuration dictates mold requirements such as whether or not a mold is considered more suitable for a large mold set-up as FIG. 2 illustrates, a small mold set-up as shown in FIG. 4, a flask type pourable investment mold as shown in FIG. 7, or whatever mold or mold type may be used in accordance with the present invention. A sprue former ring 20 (FIGS. 2, 3, 4, and 7) is required to be invested as an integral part of all gas permeable molds applicable to the present invention. Said sprue former ring incorporates a sprue former flask 22, a sealing surface 24, and a mounting device 26. Sprue former ring 20, when invested as an integral part of a gas permeable mold, provides the means for said mold to be mounted and sealed within the confines of a vacuum casting unit.

The present invention discloses a long sprue pipe 16 (FIG. 2) and a short sprue pipe 90 (FIGS. 4 and 7). Said sprue pipes provide rigid support for a central sprue to which disposable foundry patterns are attached in order to create a gas permeable mold. Said sprue pipes may be any desired length but need not be any longer than is necessary to accommodate a particular disposable foundry pattern. Coating a sprue pipe with wax, or suitable equivalent, and shaping a wax sprue pattern 76 is the first step towards setting up a typical embodiment of a sprue-forming device in accordance with the present invention. The wax coated sprue pipe is conjoined with sprue former ring 20 by concentrically arranging the smaller diameter sprue pipe inside the larger diameter sprue former flask 22 (FIG. 3) and filling the separating space with a suitable mold material, such as pourable investment 88 (FIGS. 2, 3, 4, and 7). When positioning the wax coated sprue pipe inside the sprue former ring and prior to pouring investment, said sprue pipe may be adjusted lengthwise either way in the sprue former ring to allow more or less of the sprue pipe to be used for the actual sprue. Too long a sprue pipe for a particular disposable pattern is unwieldy and may impede the investing process, which is best avoided by simply selecting a shorter pipe. The two parts become firmly joined together once the pourable investment, or it's equivalent, has completely set.

Once a sprue former ring 20 and an appropriate sprue pipe 16 or 90 has been joined together with pourable investment 88 it is ready to attach a disposable foundry pattern using the usual accepted foundry methods for attachment. Only a single sprue attachment is usually all that is required for the present invention, however, for strength purposes it may be practical to add additional gates to fragile details that may be at risk for damage during the investing process. At this time, in the process, it must be determined which embodiment of the sprue-forming device is most appropriate for the particular disposable foundry pattern being cast and set-up accordingly. Investing, drying, and burnout of the mold is done according to conventional foundry practices.

The sprue pipe is a convenient handling device during the sprueing, investing, and drying process but must be removed after investing is complete and before burnout. The sprue pipe is removed by applying sufficient heat to the sprue pipe to soften it's wax coating thereby allowing the sprue pipe to be easily withdrawn from the mold sprue.

Figure 5:
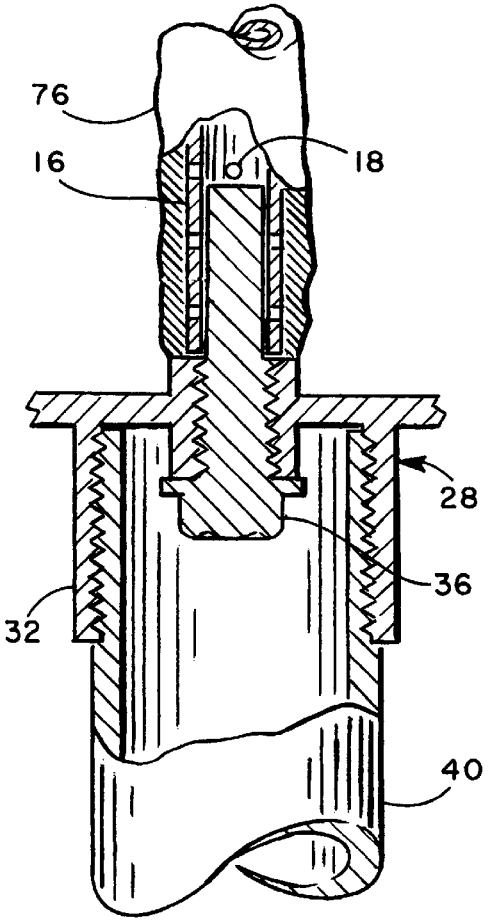
FIG. 5—Is an enlarged cross sectional view showing base plate to disposable foundry pattern connections and handle installation ready for investing in accordance with the present invention.
Figure 6:
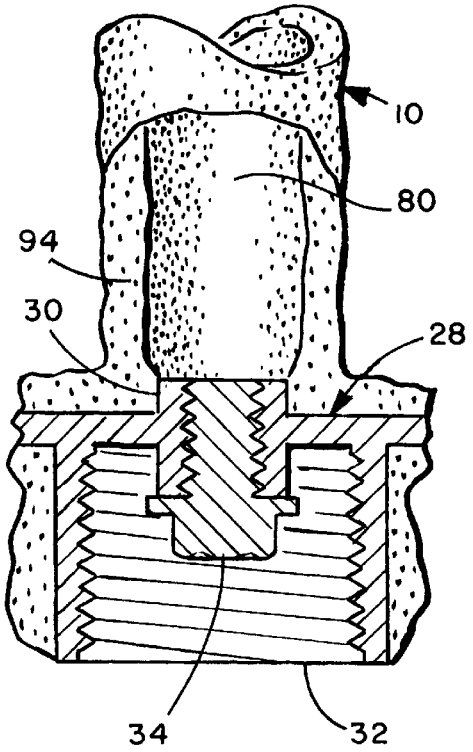
FIG. 6—Is an enlarged cross sectional view showing drain plug installation in drain port of a burned out and ready to cast gas permeable mold in accordance with the present invention.

A large gas permeable mold set-up requiring all components of the previously described sprue-forming device 12 includes a drain port 30 (FIGS. 5, and 6) as an integral part of base plate 28. Said drain port performs a dual function in the course of utilizing said sprue-forming device in accordance with the present invention. In one function, alignment plug 36 (FIG. 5) is threaded through drain port 30 and inserted into said sprue pipe. The outside diameter of the alignment plug is the same as the inside diameter of the sprue pipe thereby allowing the two parts to slip fit together where they hold fast, in proper alignment, until connecting rods 42 can be positioned and used to securely join the base plate 28 to the sprue former ring 20 along with it's conjoined sprue pipe and attached disposable foundry pattern(s). The alignment plug 36 is left in place throughout the investing and mold drying process to provide greater rigidity to the assembly of parts comprising sprue-forming device 12 (FIGS. 2, and 5). Said alignment plug is removed after investing, and before burnout to leave the drain port open in order for melted pattern material to drain freely from mold cavity 80 during burnout. A drain plug 34 (FIG. 6) must be threaded into said drain port 30 before the mold can be cast.

An alternative feature for sprue pipes involves drilling a plurality of drain holes 18 (FIG. 5) in sprue pipe to allow melted pattern material to flow inward into the sprue pipe and then out through drain port 30. Providing melted mold material a place to drain reduces the chance of mold cracking due to mold material expansion during pattern elimination.

Base plate 28 provides a convenient means for handling whenever set-up as part of the sprue-forming device. A handle mount 32 (FIGS. 5, and 6) allows a handle 40 (FIGS. 2, and 5) to be connected to said base plate by threading said handle into said handle mount. The handle and the sprue-forming device on the other end of the mold provides easy handling for two people to handle a large mold and also allows a mold to be laid across two saw-horses or similar support that allows the mold to be rolled to aid in investing. Said handle is removed before placing mold in oven (not shown) for disposable pattern elimination and burnout. Mold requirements not using drain port provisions (FIG. 4) in accordance with the present invention are invested and burned out in accordance with conventional foundry practices.

An alternative embodiment (FIG. 7) shows a typical flask type investment mold set-up with sprue former ring 20 along with short sprue pipe 90, and with sprued disposable foundry pattern 106 in place and ready to introduce pourable investment (not shown) into flask 100. Generally accepted methods of investing a flask type investment mold requires a sprued disposable foundry pattern be mounted sprue down to a flat plate 102 or other suitable sprue device. A flask is placed over the pattern and sealed down to said flat plate with wax 96 or other suitable equivalent. Said wax seals the flask down to the flat plate and prevents leakage of the pourable investment as it is poured into the flask. Vent holes 104 equalize and distribute vacuum pressure more evenly to all sides of the flask and throughout the mold when the mold is subjected to vacuum pressure and ready to cast. Tape or other suitable equivalent (not shown) is used to seal the vent holes until pourable investment has thoroughly set.

Securing one end of tie wires 108 or suitable equivalent, to various locations around the sprue former ring 20 and allowing long ends of said wires to dangle loosely down into the space separating the flask from the pattern provides sufficient bonding of the sprue former ring to the pourable investment (not shown) once said investment is thoroughly set. Investing and burn out of said flask type mold is done according to conventional foundry practices.

SEQUENCE LISTING

10 Gas permeable mold
12 Sprue-forming device
14 Disposable foundry pattern
16 Long sprue pipe
18 Drain holes
20 Sprue former ring
22 Sprue former flask
24 Sealing surface
26 Mounting device
28 Base plate
30 Drain port
32 Handle mount
34 Drain plug
36 Alignment plug
38 Base plate anchor bar
40 Handle
42 Connecting rod
44 Tie wire
46 Vacuum casting unit
48 Top closure
50 Center hole
52 Spill guard
54 Compressible seal
56 Adjustable hanger device
58 Lifting device
60 Latching device
62 Sealing surface
64 Vacuum tank
66 Vacuum chamber
68 Vacuum gauge
70 Vacuum pump connecting port
74 Compressible seal
76 Wax sprue pattern
78 Molten metal
80 Mold cavity
82 Trapped air
84 Mold wall
86 Mold sprue
88 Pourable investment
90 Short sprue pipe
92 Tie wire
94 Ceramic shell investment
96 Wax
98 Disposable foundry pattern
100 Flask
102 Flat plate
104 Vent hole
106 Disposable foundry pattern
108 Tie wire

I claim:

1. A vacuum casting apparatus for producing precision investment castings in a vacuum comprising:

a metal structure defining a sprue-forming device, to be combined with a disposable foundry pattern and subsequently invested together as integral parts of a gas permeable mold thereby providing uniform features to variable shapes and sizes of molds, an enclosure defining a vacuum chamber configured to match corresponding counterparts of said sprue-forming device, whereby said gas permeable mold will be set-up within the confines of said vacuum chamber for casting purposes, wherein the sprue-forming device further comprises:

a) a basic structural component of said sprue-forming device defining a sprue former ring that is required to be invested as an integral part of all molds pertaining to this invention and consisting of, (i) a hollow metal cylinder, defining a sprue former flask extending the gas permeable mold's sprue through a hole in the vacuum chamber and through which a sprue is formed in investment material to communicate with a mold cavity situated within said vacuum chamber and through which molten metal is introduced by gravity means into said mold's cavity from outside the vacuum chamber, (ii) a flanged end of said hollow metal cylinder defining a sealing surface and a corresponding sealing surface within said vacuum chamber, wherein said sealing surfaces are configured to combine by physical abutment to prevent outside air from entering the vacuum chamber except through the gas permeable mold sprue, (iii) an encircling frame forming the outer perimeter of said sprue former ring to which corresponding mounting counterparts of the vacuum chamber connect and hold the gas permeable mold securely in place until casting is complete, b) a provisional structural component of said sprue-forming device defining a base plate that when used is mounted opposite the sprue former ring and connected together with connecting rods and tie wire which, reinforces molds requiring greater strength than that furnished by the sprue former ring alone, and consisting of a framework with two internally threaded couplings of different diameters concentrically located within said framework, the larger of the two serving as a handle mount and the smaller inner coupling serving as a drain port through which melted pattern material flows from the mold cavity during pattern elimination, c) a pipe of any length but of smaller diameter than the sprue former flask that when coated with wax and inserted concentrically through the sprue former flask is invested as an integral part of the sprue former ring and forms the sprue to which disposable foundry patterns are attached and may further be used to connect the sprue former ring to the base plate.

2. A vacuum chamber in accordance with claim 1, further comprising, a) an enclosure defining a vacuum casting unit configured to contain a suitable gas permeable mold and composed of, (i) a vessel defining a vacuum tank with provisions for latching and connecting a vacuum device, (ii) a sealable top closure with corresponding latching components for mating top closure to vacuum tank and further configured with matching elements of the sprue former ring.

* * * * *